US006047879A

United States Patent [19]

Henrikson et al.

[11] Patent Number: 6,047,879

[45] Date of Patent: Apr. 11, 2000

[54] EXPANDING ENVELOPE WITH A UTILITY POCKET

[75] Inventors: Damon Henrikson, Waukegan; Marcia Lausen, Evanston; A. J. Vasilatos, Wilmette, all of Ill.

[73] Assignee: ACCO Brands, Inc., Lincolnshire, Ill.

[21] Appl. No.: 09/100,342

[22] Filed: Jun. 19, 1998

[51] Int. Cl.[7] ..... B65D 5/18

[52] U.S. Cl. ..... 229/67.3; 229/67.4; 229/72

[58] Field of Search ..... 281/31; 206/308.3; 383/38, 39, 40; 229/72, 67.1, 67.3, 67.4

[56] References Cited

U.S. PATENT DOCUMENTS

| | | | |
|---|---|---|---|
| 325,676 | 9/1885 | Jenkins . | |
| 594,620 | 11/1897 | Harris . | |
| 621,732 | 3/1899 | Wyman . | |
| 673,387 | 5/1901 | Dean . | |
| 783,365 | 2/1905 | Coleman . | |
| 930,837 | 8/1909 | Bushnell, Jr. . | |
| 979,213 | 12/1910 | Shedd . | |
| 1,175,691 | 3/1916 | Blizard . | |
| 1,463,827 | 8/1923 | McNeill et al. . | |
| 1,564,557 | 12/1925 | Greenhaus | 229/72 |
| 1,743,305 | 1/1930 | Banks . | |
| 1,759,255 | 5/1930 | Greenhaus | 229/67.4 |
| 1,774,215 | 8/1930 | Weinthrop . | |
| 1,794,560 | 3/1931 | Styll . | |
| 2,354,820 | 8/1944 | McCarty | 229/72 |
| 2,599,768 | 6/1952 | Losch, Jr. . | |
| 2,756,515 | 7/1956 | Hoffman . | |
| 3,224,661 | 12/1965 | Tilton, Jr. . | |
| 3,528,602 | 9/1970 | Ritchie . | |
| 3,620,440 | 11/1971 | Humphrey . | |
| 3,693,868 | 9/1972 | Rich | 383/40 |
| 3,847,195 | 11/1974 | Tyrseck . | |
| 4,086,945 | 5/1978 | Carter | 383/38 X |
| 4,109,850 | 8/1978 | Meenan et al. . | |
| 4,485,962 | 12/1984 | Farley . | |
| 4,549,688 | 10/1985 | Ozmon et al. . | |
| 5,031,772 | 7/1991 | Woodriff . | |
| 5,050,792 | 9/1991 | Segall . | |
| 5,161,731 | 11/1992 | Rivlin et al. . | |
| 5,174,606 | 12/1992 | Hure . | |
| 5,256,130 | 10/1993 | Kachel et al. . | |
| 5,275,438 | 1/1994 | Struhl . | |
| 5,288,144 | 2/1994 | Guderyon | 281/31 X |
| 5,558,454 | 9/1996 | Owen . | |
| 5,579,908 | 12/1996 | Johnson . | |
| 5,711,750 | 1/1998 | Christensen et al. . | |
| 5,720,427 | 2/1998 | Kachel et al. . | |
| 5,730,284 | 3/1998 | Farrah | 281/31 X |
| 5,806,754 | 9/1998 | Boyle | 229/72 |

FOREIGN PATENT DOCUMENTS

| | | | |
|---|---|---|---|
| 477151 | 9/1951 | Canada . | |
| 0500395 | 2/1992 | European Pat. Off. . | |
| 510382 | 8/1931 | Germany | 383/40 |
| 432220 | 9/1967 | Switzerland | 229/72 |
| 553065 | of 0000 | United Kingdom . | |
| 30103 | 11/1928 | United Kingdom | 383/40 |
| 412683 | 7/1934 | United Kingdom . | |
| 862396 | 1/1953 | United Kingdom . | |

OTHER PUBLICATIONS

Combined Search and Examination Report, British Patent Office, Sep. 10, 1999.

*Primary Examiner*—Jes F. Pascua

*Attorney, Agent, or Firm*—Townsend and Townsend and Crew LLP

[57] ABSTRACT

A file that has a receptacle with a first panel that defines a boundary of the receptacle, and an expandable pocket with a pocket panel. The pocket panel is narrower than the first panel and is attached to the outside thereof by an expandable wall, which permits the pocket panel to move with respect to the first panel while remaining parallel thereto. A non-fibrous, transparent tape is also provided at outside corners of a gusset of the main receptacle to protect the corners from wear.

6 Claims, 7 Drawing Sheets

EXPANDING ENVELOPE WITH A UTILITY POCKET

BACKGROUND OF THE INVENTION

Files are known with front and back rectangular panels attached to each other with gussets for containing items such as stacks of paper. U.S. Pat. No. 5,161,731, for example, teaches an expandable folder with a single compartment for filing papers. The folder has corner strips of a Tyvek® thermoplastic film, which is fibrous and opaque, and thus requires a its color to be matched to the rest of the file if a single color file is desired, which is difficult to achieve accurately and limits the number of colors that may be employed.

To separate multiple contents in a single file, U.S. Pat. No. 325,676 teaches a paper file with multiple compartments in the interior of the file, formed by paper partitions placed between two rectangular cardboard sides. Each compartment has a similar planform as the sides of the file.

It is often desirable however to place smaller objects in a file with larger ones, but separately therefrom and more easily accessible. Small items merely placed within the main compartment of a file are difficult to keep from sliding around inside the compartment. Also, the small objects can become hard to find, as they become wedged between the larger objects. U.S. Pat. No. 4,485,962 teaches a compartmentalized file folder with two expandable pockets mounted on the inside of a folder. One of the expandable pockets is smaller than the other and is mounted to the outside thereof. The pockets expand at an angle to the surface to which they are fixed, decreasing their ability to carry bulky items, such as small pads of paper or compact disk cases.

SUMMARY OF THE INVENTION

The invention relates to a file that has a large receptacle and a small pocket particularly suited to carry stacks of paper or other rectangular objects. The receptacle has a first panel of a first width, which defines a boundary of the receptacle compartment. The pocket has a panel of smaller width than the first panel. An expandable pocket wall connects the pocket panel to the outside of the first panel. The pocket wall is preferably a gusset configured to allow the pocket panel to move towards and away from the first panel while remaining parallel thereto. As a result, the pocket is especially suited to carry pads of paper or compact disks, or other rectangular objects, separately from objects in the receptacle compartment.

The pocket panel preferably has a flap that extends above the pocket wall and that is engageable between the first panel and a tongue protruding therefrom. The tongue thus holds the pocket closed.

The receptacle also preferably has a gussetted wall that is protected from wear by a non-fibrous, transparent tape affixed to the corners thereof. Because the tape is transparent, the same tape can be employed with any color file. Also, because the tape is non-fibrous, it has been found to last longer than traditional fibrous protecting strips.

DETAILED DESCRIPTION OF THE PREFERRED EMBODIMENTS

Figure 1:
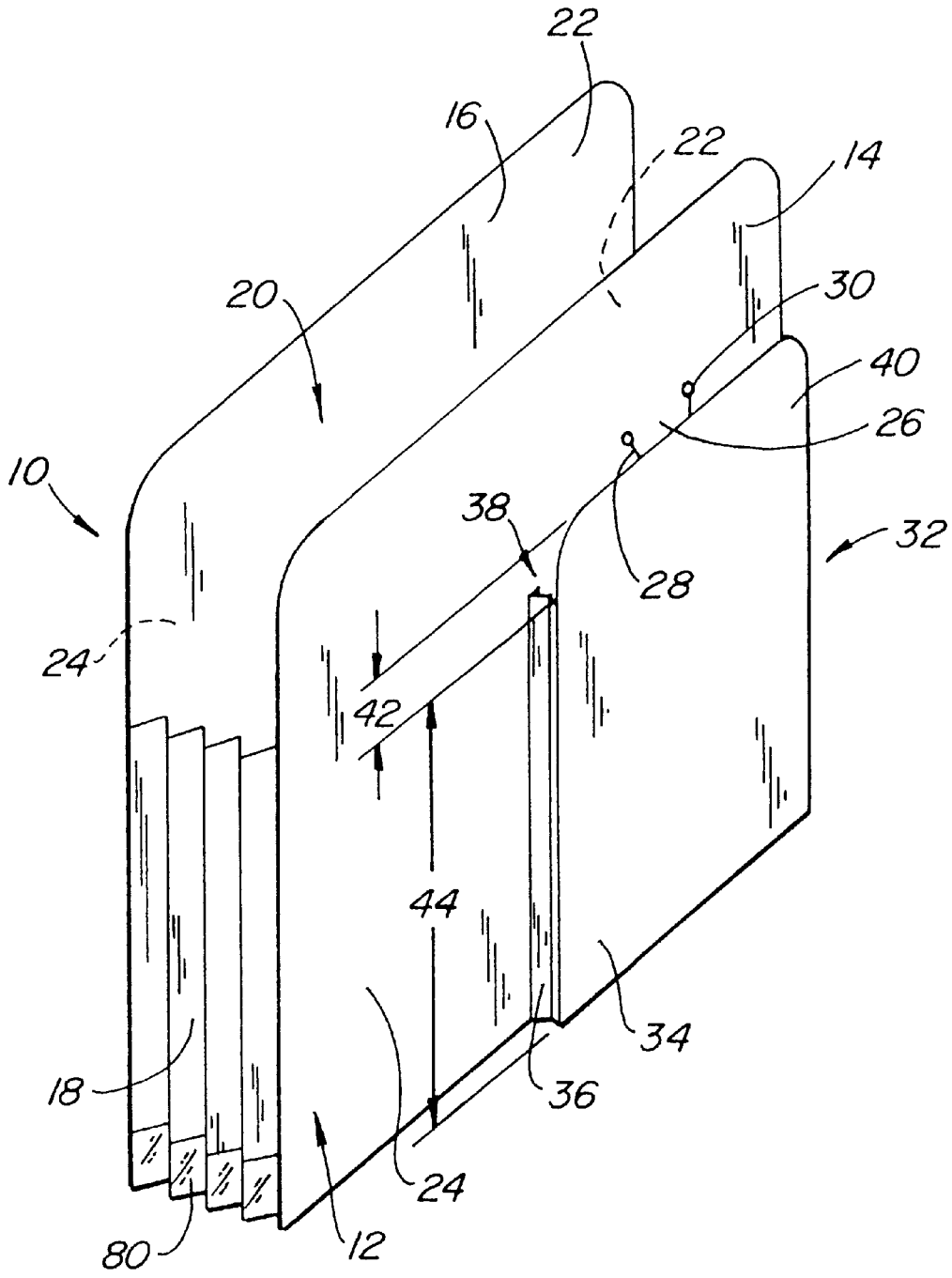
FIG. 1 is a perspective view of a preferred embodiment of a file constructed according to the invention.
Figure 2:
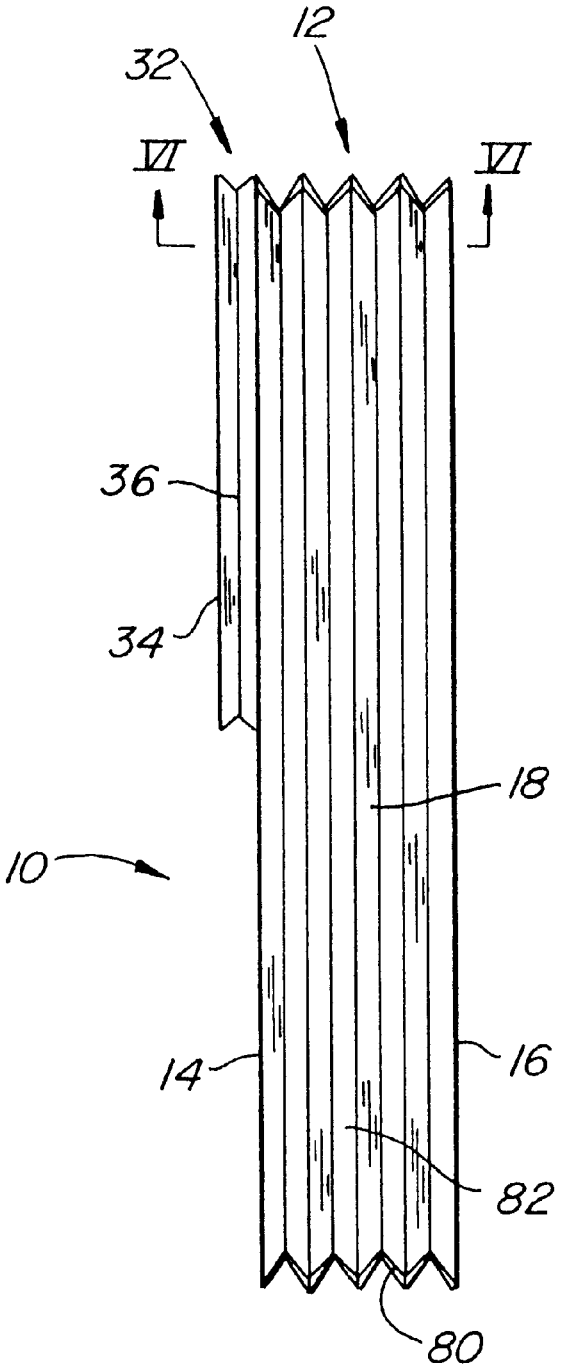
FIG. 2 is a bottom view of the file.

Referring to FIGS. 1 and 2, a preferred embodiment of the invention is a file 10 with a receptacle 12 with a front panel 14 and a back panel 16. An expandable receptacle wall 18 connects the front and back panels 14 and 16. The receptacle wall 18 extends around the periphery of the left and right sides of the front and back panels 14 and 16 and of the bottom thereof. The receptacle wall 18 wall includes accordion-fold gussets, allowing the front and back panels 14 and 16 to move towards and away from each other.

A large, receptacle compartment 20 open at the top of the receptacle 12 is thus defined between the front and back panels 14 and 16 and the receptacle wall 18, and thus has these panels 14 and 16 and wall 18 as its boundaries. The front and back panels 14 and 16 have insides 22 facing into the receptacle compartment 20, and outsides 24 facing away from the receptacle compartment 20. The front panel 14 is vertically slightly shorter than the back panel 16 so that labels affixed to the inside of the back panel 16 are visible over the top of the front panel 14.

The expandable receptacle wall 18 permits the receptacle compartment 20 to be expanded or contracted depending on the size of the objects placed therein. Also, because the edges of the front and back panels 14 and 16 are only connected to each other through the gussets of the receptacle wall 18, the front and back panels 14 and 16 can move with respect to each other while remaining in parallel.

The front panel 14 has a tongue 26, which is preferably stamped from the front panel 14 during construction, leaving a slit 28 about the periphery of the tongue 26 when the tongue is disposed in a common plane with the body of the front panel 14. The tongue 26 is protrudable front the front panel 14 and preferably has a rounded shape. Rounded holes 30 are made at the base of the tongue, at ends of the slit 28. Holes 30 relieve stress concentrations at the edges of the slit 28, reducing the tendency for the front panel 14 to tear on each side of the tongue 26.

The file 10 also has an expandable utility-pocket 32 on the outside of the receptacle compartment 20. The pocket is formed by a pocket panel 34 connected to the front panel 14 by an expandable pocket wall 36, which preferably comprises an accordion-fold gusset. The pocket wall 36 extends around the periphery of the left and right sides and the bottom of the pocket panel 34.

A pocket compartment 38 is defined between the pocket wall 36, the pocket panel 34, and the outside 24 of the front panel 14. The pocket compartment 38 is open at the top thereof. The pocket wall 36 allows the pocket panel 34 to move towards and away from the front panel 14 while at least a portion of the pocket panel 34 remains parallel to the front panel 14. This permits the pocket 32 to conform to the size of items of substantially rectangular cross-sections, such as compact disk covers or small pads or stacks of paper.

The top of the pocket panel 34 is a flap 40 the extends upwardly beyond the pocket wall 36 adjacent the open side of the pocket compartment 38 and is free from the pocket wall 36. The flap 40 extends beyond the pocket wall 36 preferably by a distance 42, which is at least a fifteenth of the height 44 of pocket wall 36 on the lateral sides of the pocket panel 34, and about as long as maximum extension 37 of the pocket wall 36, as shown in FIG. 5.

Figure 3:
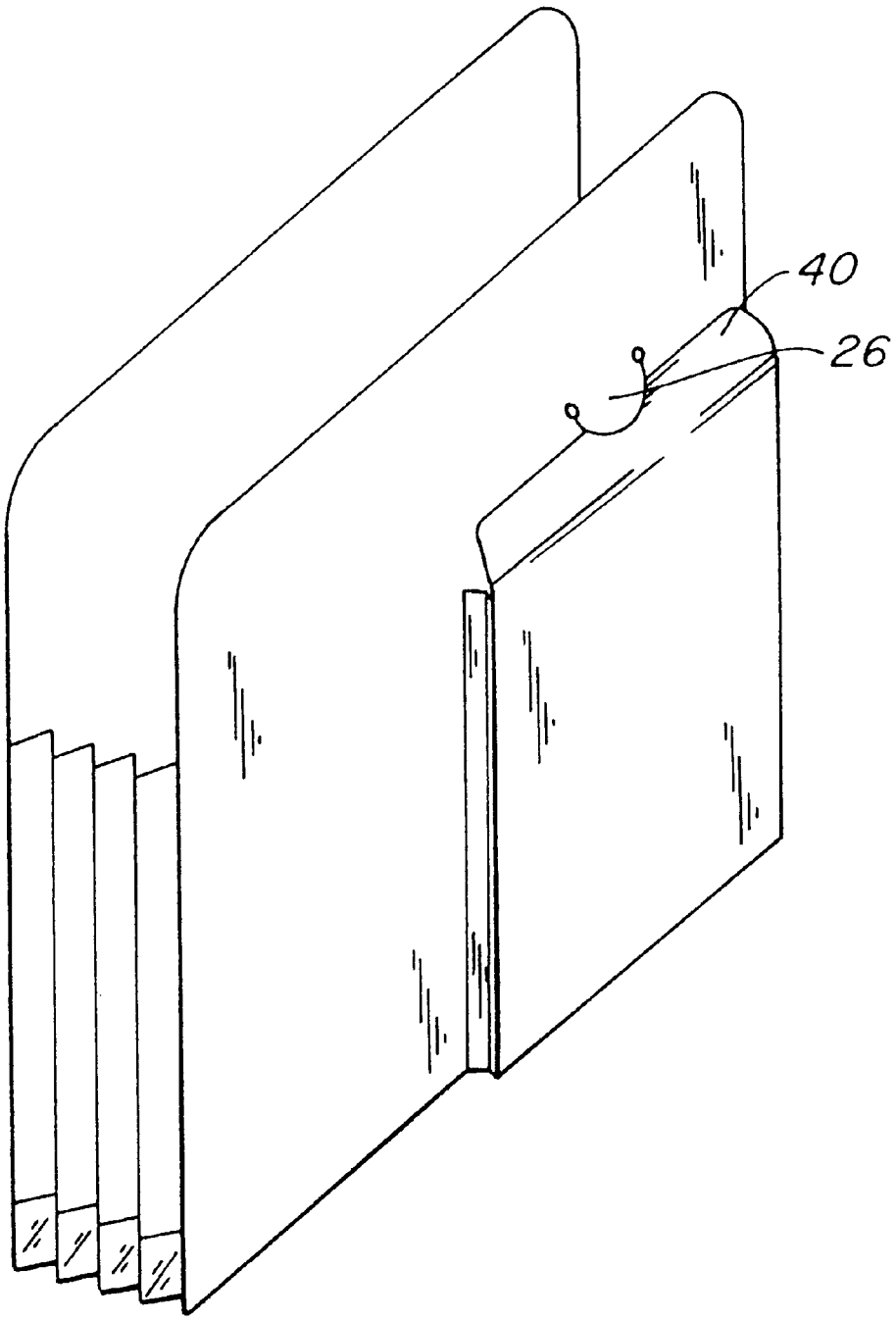
FIG. 3 is a perspective view of the file with a pocket in a closed configuration.
Figure 4:
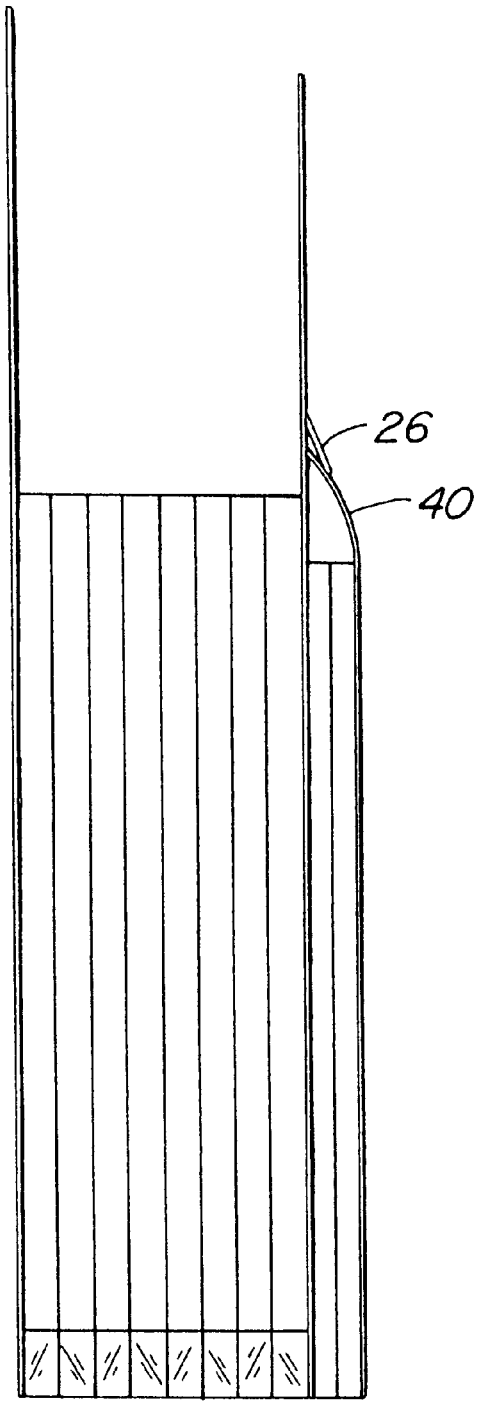
FIG. 4 is a side view of the file of FIG. 3.

The flap 40 is engageable to the front panel 14, as shown in FIGS. 3 and 4. The tongue 26 and the flap 40 are engageable to each other with the flap 40 received and retained between the tongue 26 and the front panel 14. When the tongue 26 is engaged with the flap 40 as shown, the pocket compartment 38 is closed, keeping the contents of the pocket compartment 38 securely therein.

Figure 5:
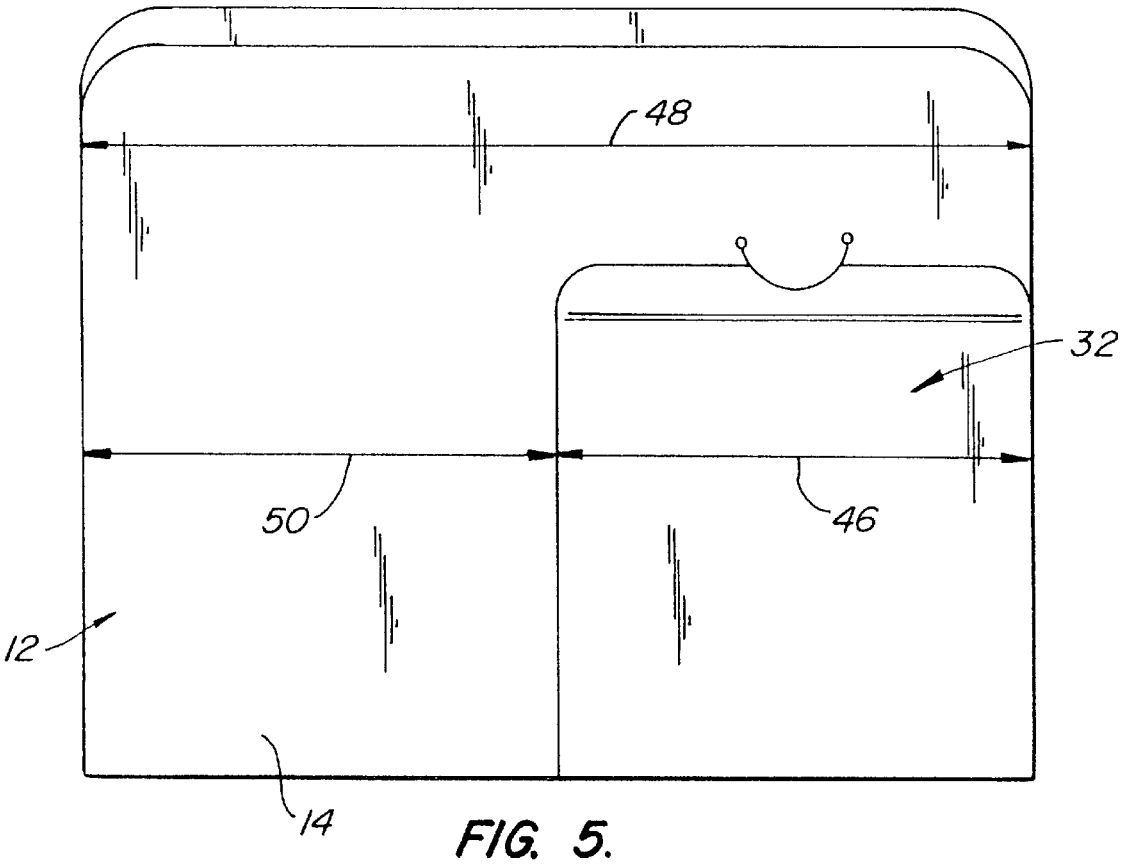
FIG. 5 is a front view of the file.

Referring to FIG. 5, the width 46 of the pocket panel 34 is smaller than the width 48 of the front panel 14. Consequently, the pocket 32 is better suited to hold smaller items than the receptacle 12. The width 46 of the pocket panel 34 is preferably less than about half of the width 48 of the front panel 14, with the pocket 32 positioned on the front panel 14 such that a space 50, at least as wide as the width 46 of the pocket panel 34, remains on the front panel 14 adjacent the pocket 32. This construction permits similar files 10 to be stacked front to front and back to back, without the pockets 32 interfering with each other. Other arrangements in which facing files have staggered pockets are also suitable.

Figure 6:
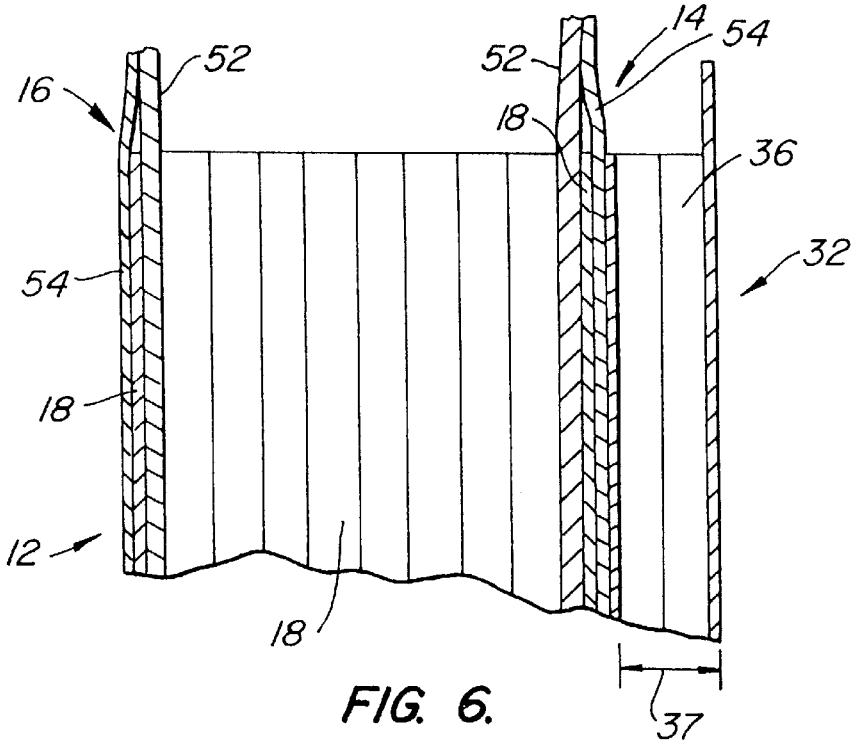
FIG. 6 is a cross-sectional view through plane VI—VI of FIG. 2.

Referring to FIG. 6, the file 10 is preferably made from a strong paperboard material, such as manila or kraft paper. The pocket panel 34 and pocket wall 36 are preferably a single piece of paper, and the receptacle wall 18 is also made from a single piece of paper. The front and back panels 14 and 16 preferably include an inside and an outside sheet of paper 52 and 54, which are adhered to each other about edges of the receptacle wall 18. The pocket wall 36 has an edge 56 adhered to the outside sheet 54 of the front panel 14. The inside sheets 54 are thicker and sturdier than the outside sheets 52. Preferably, the thick inner sheets 54 are at least 15 point panels. An acrylic coating is applied to the paper to render the paper water resistant and wipeable.

The file 10 also has a reinforcing tape 80 that is adhered to the receptacle wall 18 at the bottom corners thereof and along the lateral sides thereon. Preferably, however, the tape 80 does not extend onto the horizontal bottom 82 of the receptacle wall 18. The tape 80 is a transparent film, preferably a polyester film, such as Mylar®, which is sold by Dupont. The tape is preferably homogenous and does not include fibers therein. The transparency of the tape 80 makes it substantially invisible without close inspection, and does not require its color to be matched to that of the receptacle wall. In addition, it has been found that polyester tape resists wear better than fibrous reinforcement materials, such as Tyvek® brand thermoplastic film.

Figure 7:
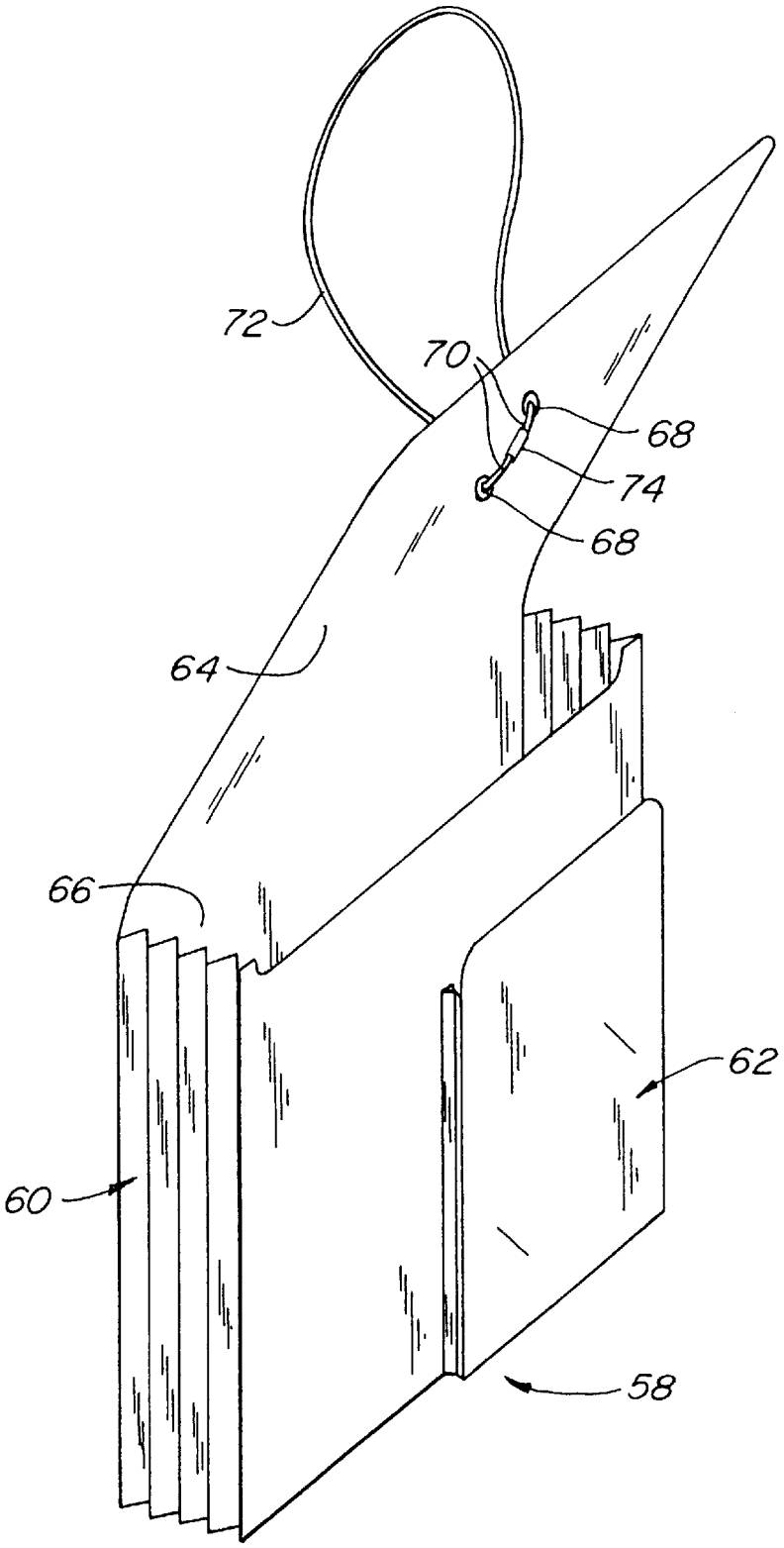
FIG. 7 is a perspective view of another embodiment of the invention.

Referring to FIG. 7, an alternative embodiment of the invention is a file 58 that has an expandable receptacle 60 and an expandable utility pocket 62 attached to the outside of the receptacle 60. A cover 64 is connected to back panel 66 of the receptacle 60.

Two eyelets 68 are fitted in holes through the lateral center of the over 64, and an elastic band 70 extends through the eyelets 68. Ends 72 are spliced together with a butt splice 74.

Figure 8:
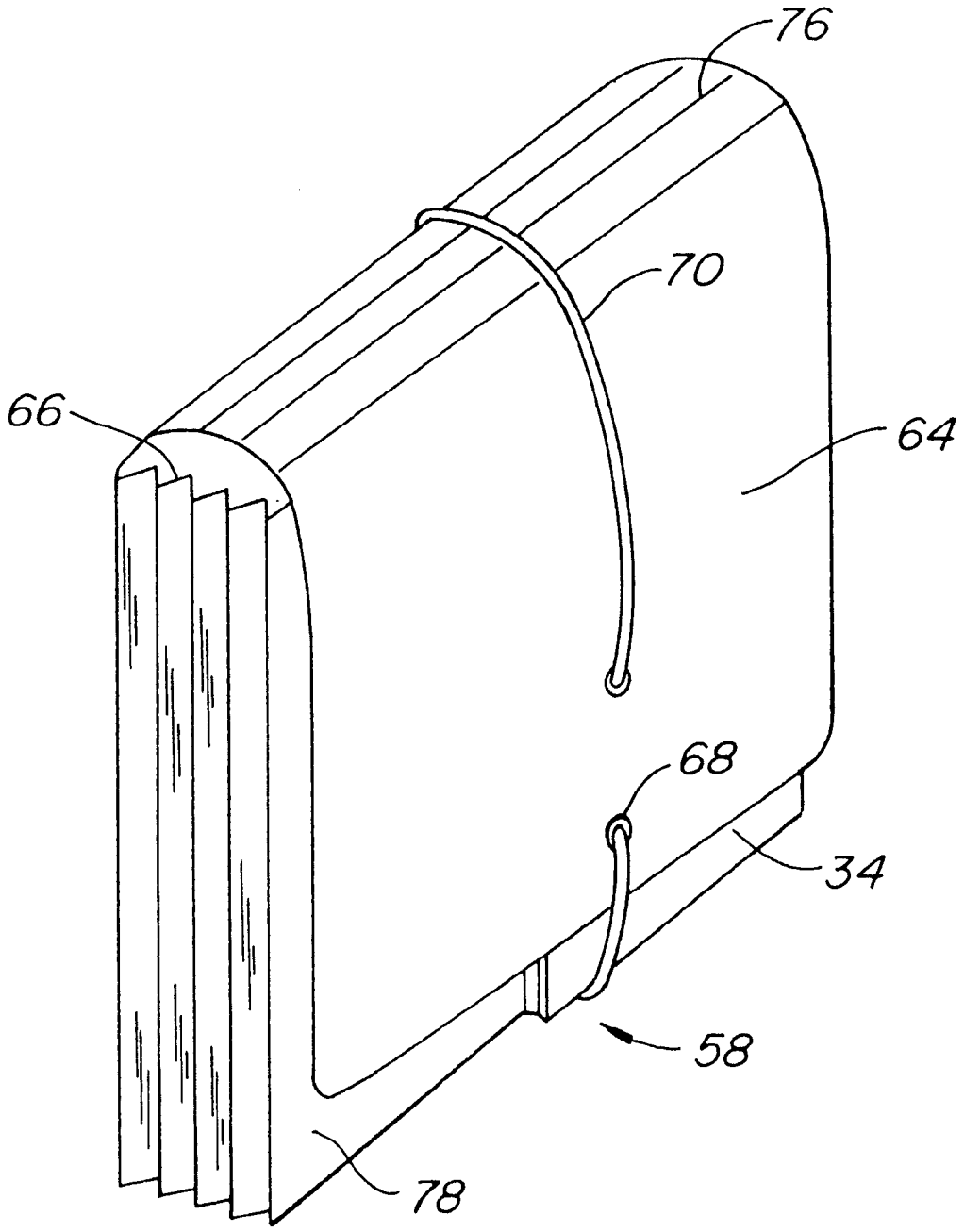
FIG. 8 is a perspective view of the file of FIG. 7 in a closed configuration.

As shown in FIG. 8, the cover 64 is positionable over the open sides of the receptacle 60 and of the pocket 62 in a closed position to close these open sides and positively retain the contents of both compartments. The elastic band 70 surrounds the file 58, maintaining the cover 64 in the closed position.

As also shown in FIG. 8, the cover 64 has a plurality of scores 76 or creases extending substantially in parallel with the panels 16, 34, and 78 of the file 58. Creases 76 facilitate and localize bending of the cover 64 around the top of the file 58.

One of ordinary skill in the art can envision numerous variations and modifications. All of these modifications are contemplated by the true spirit and scope of the following claims.

What is claimed is:

1. A file comprising:

(a) a receptacle including a first panel of a first width, defining a boundary of a first compartment, and having an inside facing inside the compartment and an outside facing outside the compartment; and (b) an expandable pocket with:

(i) a second panel of a second width smaller than the first width and having a parallel portion that is disposable substantially in parallel with the first panel, and (ii) an expandable pocket wall connecting the first and second panels such that the second panel is disposed outside of the first compartment facing the outside of the first panel and is movable with respect to the first panel while remaining substantially parallel thereto, wherein a second compartment is defined between the expandable pocket wall, the second panel, and the outside of the first panel;

wherein the pocket wall comprise gussets;

wherein the receptacle includes:

(a) a third panel; and (b) an expandable receptacle wall connecting the first and third panels;

wherein the first compartment is defined between the first and third panels and the expandable receptacle wall; and further comprising a cover connected to the third panel and positionable over the pocket in a closed cover position.

2. The file of claim 1, wherein:

(a) the receptacle and the cover have open sides; and (b) in the closed cover position the cover covers the open sides of both the receptacle and the pocket.

3. A file comprising:

(a) a receptacle including a first panel of a first width, defining a boundary of a first compartment, and first width, defining a boundary of a first compartment, and having an inside facing inside the compartment and an outside facing outside the compartment; and (b) an expandable pocket having an open side and including:

(i) a second panel of a second width smaller than the first width, having a parallel portion that is disposable substantially in parallel with the first panel, and having an engageable portion adjacent the open side which is engageable with the first panel for closing the pocket, (ii) an expandable pocket wall connecting the first and second panels such that the second panel is disposed outside of the first compartment facing the outside of the first panel and is movable with respect to the first panel while remaining substantially parallel thereto;

wherein a second compartment is defined between the expandable pocket wall, the second panel, and the outside of the first panel further comprising a tongue protrudable from one of the first panel and the engageable portion, the tongue being configured for engaging the other of the first panel and the engageable portion for closing the pocket.

4. The file of claim 3, wherein the tongue protrudes from the first panel and is engageable about the engageable portion, with the engageable portion retained between the tongue and the first panel.

5. A file comprising:

(a) a receptacle including a first panel of a first width, defining a boundary of a first compartment, and first width, defining a boundary of a first compartment, and having an inside facing inside the compartment and an outside facing outside the compartment; and (b) an expandable pocket having an open side and including:

(i) a second panel of a second width smaller than the first width, having a parallel portion that is disposable substantially in parallel with the first panel, and having an engageable portion adjacent the open side which is engageable with the first panel for closing the pocket, (ii) an expandable pocket wall connecting the first and second panels such that the second panel is disposed outside of the first compartment facing the outside of the first panel and is movable with respect to the first panel while remaining substantially parallel thereto;

wherein a second compartment is defined between the expandable pocket wall, the second panel, and the outside of the first panel;

wherein the engageable portion comprises a flap with lateral flap edges that are substantially free from the expandable pocket wall, the flap being engageable with the first panel for closing the pocket.

6. The file of claim 5, wherein the flap extends beyond the pocket wall in the direction of the open side of the pocket.

* * * * *